United States Patent [19]

Chung

[11] Patent Number: 4,928,930

[45] Date of Patent: May 29, 1990

[54] BALUSTRADE

[76] Inventor: Yu-Kuei Chung, No. 15, Yung-An St., Feng-Yu City, Taiwan

[21] Appl. No.: 430,561

[22] Filed: Nov. 2, 1989

[51] Int. Cl.[5] ..... E04H 17/14

[52] U.S. Cl. ..... 256/67; 256/65; 403/73; 403/116

[58] Field of Search ..... 256/59, 65, 67, 22; 403/57, 61, 73, 74, 76, 79, 84, 87, 98, 103, 104, 116

[56] References Cited

U.S. PATENT DOCUMENTS

| | | | |
|---|---|---|---|
| 684,451 | 10/1901 | Mowry | 403/87 |
| 4,138,094 | 2/1979 | Thir | 256/67 |
| 4,155,590 | 5/1979 | Cunningham | 403/87 X |
| 4,272,061 | 6/1981 | Suckno | 256/67 |
| 4,408,749 | 10/1983 | Zieg | 256/67 |
| 4,421,302 | 12/1983 | Grimm et al. | 256/67 |
| 4,505,456 | 3/1985 | Zieg | 256/67 |

FOREIGN PATENT DOCUMENTS

| | | | |
|---|---|---|---|
| 1008216 | 10/1965 | United Kingdom | 256/67 |

*Primary Examiner*—Randolph A. Reese
*Assistant Examiner*—Franco S. DeLiguori
*Attorney, Agent, or Firm*—Pasquale A. Razzano

[57] ABSTRACT

A balustrade includes a top and bottom rail, and a plurality of plug members respectively fixed in aligned grooves of the top and bottom rails. Each of the plug members includes a U-shaped portion and two flap portions extending respectively from the U-shaped portion. Each of the U-shaped portions of the plug members has a guiding slot with two enlarged ends formed therein. A plurality of balusters of equal length are parallelly mounted between the top and bottom rails. Each of the balusters has two end portions respectively and rotatably received in one of the plug members on the top rail and one of the plug members on the bottom rail. Each of the end portions of the balusters has a retaining member fixed thereto which is slidably retained in the guiding slots to prevent the end portions of the balusters from separating from the plug members of the rails. Therefore, the angle between the top rail and each of the balusters can be adjusted by means of parallelly moving the top rail relative to the bottom rail, so as to enable both the top and bottom rails to be substantially parallel with a staircase to which the balustrade is mounted.

3 Claims, 3 Drawing Sheets

BALUSTRADE

BACKGROUND OF THE INVENTION

This invention relates to a balustrade, more particularly to a balustrade which has a top and a bottom rail having a plurality of balusters parallelly mounted therebetween, the angle between the top rail and each of said balusters being adjustable before mounting said balustrade to the newel posts fixed to the staircase.

Conventionally, a row of balusters is topped by a handrail to serve as a balustrade along the edge of a staircase. Each of the balusters is fixed into the trades of the staircase at one end thereof and fixed to the handrail at the other end thereof. It is necessary for a worker, on the jobsite, to accurately measure the angle between the handrail and each of the balusters during a mounting process. Thereby, the balustrade can be arranged so that the handrail is fixed to the balusters in a substantially parallel relation relative to the staircase for aesthetic purposes. However, such a mounting process is messy, increasing the labor cost therefor.

SUMMARY OF THE INVENTION

It is therefore a main object of this invention to provide a balustrade having a top and bottom rail and a row of balusters mounted therebetween, in which the angle between the top rail and each of the balusters is adjustable, so as to conveniently enable both said top and bottom rails to be substantially parallel with the staircase to which said balustrade is mounted.

Accordingly, a balustrade of this invention includes a top and a bottom rail each of which has a face having a plurality of aligned grooves formed along the length thereof. A plurality of plug members are respectively fixed in the grooves of the top and bottom rails. Each of the plug members includes a U-shaped portion having two arms and an open side, and two flap portions extending respectively from the two arms of the U-shaped portion in an opposite direction relative to the open side of the U-shaped portion. Each of the plug members is fixed in the grooves of the rails with the open side of the U-shaped portion thereof facing the faces of the rails. Each of the U-shaped portions of the plug members has a guiding slot with two enlarged ends formed therein. A plurality of balusters of equal length are parallelly mounted between the top and bottom rails. Each of the balusters has two end portions respectively and rotatably received in one of the U-shaped portions of the top rail and a corresponding one of the U-shaped portions of the bottom rail. Each of the end portions of the balusters has a retaining member fixed thereto which is slidably retained in the guiding slots to prevent the end portions of the balusters from separating from the plug members of the rails. Therefore, the angle between the top rail and each of the balusters can be adjusted by means of parallelly moving the top rail relative to the bottom rail, so as to enable both said top and bottom rails to be substantially parallel with the staircase to which said balustrade is mounted during a jobsite mounting process.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENT

Figure 1:
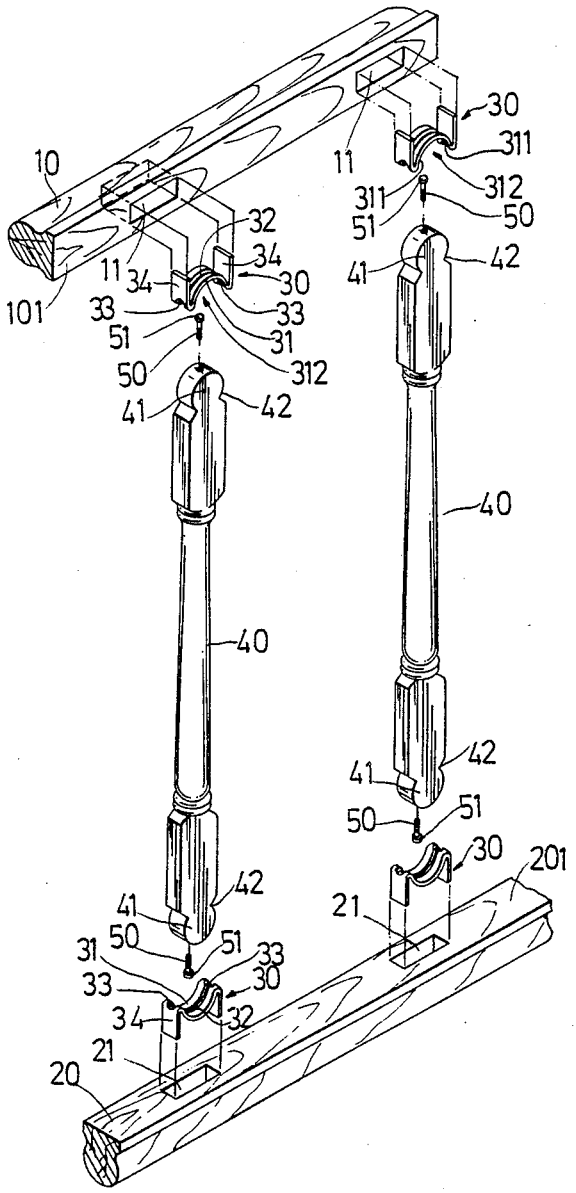
FIG. 1 is a perspective exploded view of a preferred embodiment of a balustrade of this invention.
Figure 2:
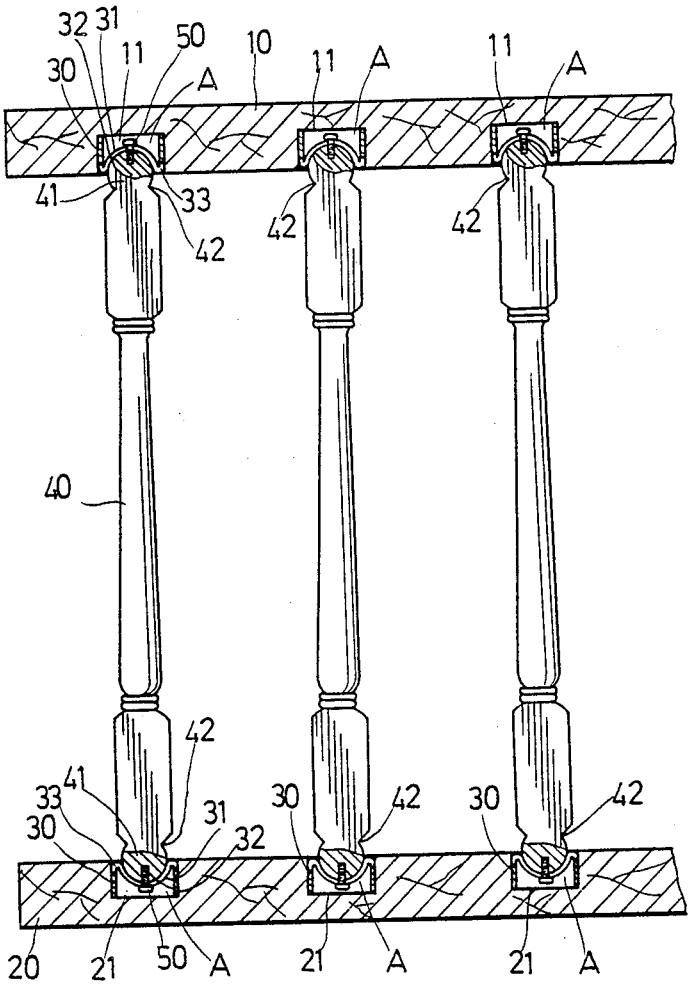
FIG. 2 is a partial cross-sectional view of the preferred embodiment of a balustrade of this invention.

Referring to FIGS. 1, 2, a preferred embodiment of a balustrade of this invention includes a top rail 10 and a bottom rail 20. Each of said top rails 10 and bottom rails 20 has a face 101, 201 respectively provided with a plurality of aligned, rectangular grooves 11, 21 which are formed along the length of the top and bottom rails 10, 20. A plurality of plug members 30 are respectively fixed in the grooves 11, 21 of the top and bottom rails 10, 20. Each of the plug members includes a U-shaped portion 31 having two arms 311 and an open side 312, and two flap portions 34 extending respectively from the two arms 312 of the U-shaped portion 31 in an opposite direction relative to the open side 312 of the U-shaped portion 31. Each of the plug members 30 is fitted into the grooves 11, 21 of the top and bottom rails 10, 20 and fixed therein by means of an adhesive, with the open side 312 of the U-shaped portion 31 thereof facing the faces 101, 201 of the top and bottom rails 10, 20. Each of the U-shaped portions 31 of the plug members 30 has a guiding slot 32 with two enlarged ends 33 formed therein. A plurality of balusters 40 of equal length are parallelly mounted between the top and bottom rails 10, 20. Each of the balusters 40 has two rounded end portions 41 respectively and rotatably received in one of the U-shaped portions 31 of the top rail 10 and one of the U-shaped portions 31 of the bottom rail 20. Each of the rounded end portions 41 of the balusters 40 has a screw bolt 50 with a bolt head 51 threaded thereon which is slidably retained in the guiding slots 32 and prevents the rounded end portions 41 of the balusters 40 from separating from the plug members 30 of the rails 10, 20.

In assembly, the plug member 30 is first fixed into the grooves 11, 21 of the top and bottom rails 10, 20 in the abovementioned manner so that a clearance (A) is formed between the rounded end portions 41 of the balusters 40 and the bottom of each of the grooves 11, 21 of the rails 10, 20. The screw bolts 50 are then respectively threaded to the rounded end portions 41 of each of the balusters 40. Next, each of the bolt heads 51 of the screw bolts 50 is passed through one of the enlarged ends 33 of each of the guiding slots 32 of the plug members 30 so that rounded ends 41 of the balusters 40 can be rotatably and slidably retained in the grooves 11, 21 of the top and bottom rails 10, 20 as hereinbefore described and as best illustrated in FIG. 2. In addition, a necked portion 42 is formed near both the rounded end portions 41 of each of the balusters 40 so that the balusters 40 can be inclined relative to the top rail 10 and bottom rail 20 with little hindrance.

Figure 3:
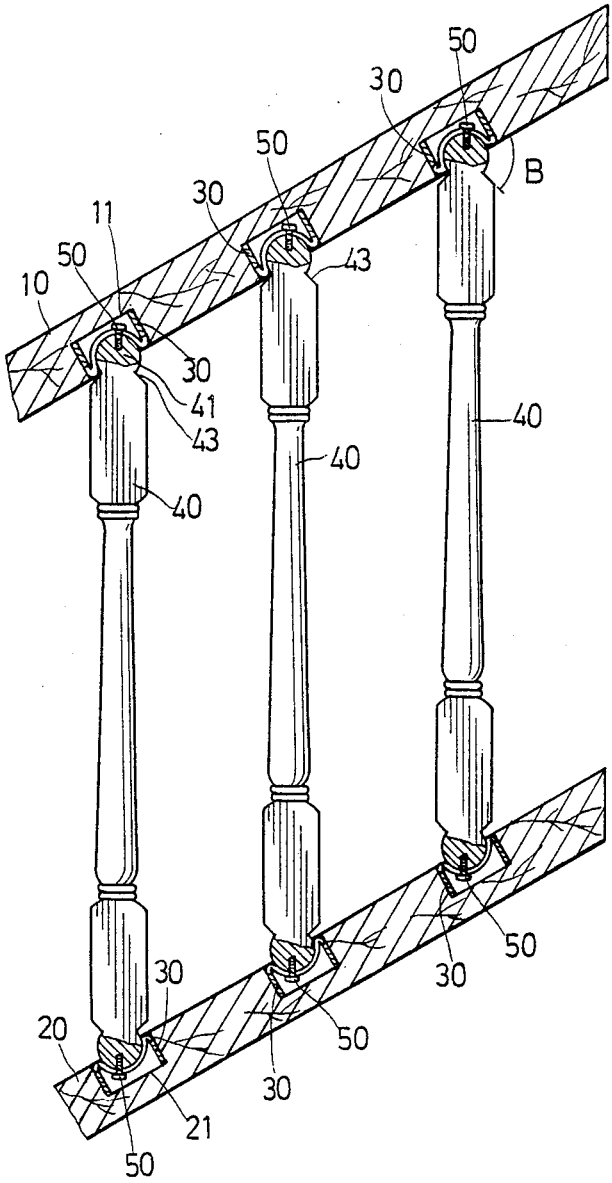
FIG. 3 is a partial cross-sectional view showing the preferred embodiment of the balustrade of this invention in a mounted position.

Before mounting the balustrade of this invention to two newel posts respectively fixed at the top and the bottom of the staircase (not shown), the top and bottom rails 10, 20 are parallelly moved relative to each other so as to be substantially parallel to the staircase to which the balustrade is to be mounted. During the relative movement of the top and bottom rails 10, 20, the screw bolts 50, which are fixed to the rounded end portions 41 of the balusters 40, slide along the guiding slots 32 of the plug member 30 which are fixed in the top and bottom rails 10, as best illustrated in FIG. 3. Therefore, the angle (B) between said top rail 10, or the bottom rail and one of the balusters 40, is adjustable. Thereby, a worker can conveniently adjust the angle (B) between the top rail 10 and the balusters 40 so as to make the top and bottom rails 10, 20 parallel to the staircase to be mounted without complicated measurement of the angle (B) between the top rail 10 and the balusters 40 during a jobsite mounting process.

With this invention thus explained, it is apparent that numerous modifications and variations can be made without departing from the scope and spirit of this invention. It is therefore intended that this invention be limited only as indicated in the appended claims.

I claim:

1. A balustrade comprising:

a top and bottom rail each of which has a face having a plurality of aligned grooves formed along a length thereof;

a plurality of plug members each of which includes a U-shaped portion having two arms and an open side, and two flap portions extending respectively from said two arms of said U-shaped portion in an opposite direction relative to said open side of said U-shaped portion, each of said plug members being fixed in said grooves of said rails with said open side of said U-shaped portion thereof facing said faces of said rails, each of said U-shaped portions of said plug members having a guiding slot with two enlarged ends formed therein; and a plurality of balusters of equal length parallelly mounted between said top and bottom rails, each of said balusters having two end portions respectively and rotatably received in one of said U-shaped portions of said plug members on said top rail and one of said U-shaped portions of said plug members on said bottom rail, each of said end portions of said balusters having a retaining member fixed thereto which is slidably retained in said guiding slots to prevent said end portions of said balusters from separating from said plug members of said rails, so that an angle between said top rail and ea-h of said balusters can be adjusted by means of parallelly moving said top rail relative to said bottom rail.

2. A balustrade as claimed in claim 1, wherein each of said balusters has a necked portion formed near both of said end portions thereof.

3. A balustrade as claimed in claim 1, wherein said retaining member is a bolt screw with a bolt head which is to be passed through said enlarged ends of said guiding slot of said plug member and slidably retained by said guiding slot.

* * * * *